US008387248B2

(12) United States Patent
Rolt et al.

(10) Patent No.: US 8,387,248 B2
(45) Date of Patent: Mar. 5, 2013

(54) HEAT EXCHANGER

(75) Inventors: Andrew M. Rolt, Derby (GB); Anthony G. Razzell, Derby (GB)

(73) Assignee: Rolls-Royce, PLC, London (GB)

( * ) Notice: Subject to any disclaimer, the term of this patent is extended or adjusted under 35 U.S.C. 154(b) by 1231 days.

(21) Appl. No.: 12/219,373

(22) Filed: Jul. 21, 2008

(65) Prior Publication Data

US 2009/0044933 A1 Feb. 19, 2009

(30) Foreign Application Priority Data

Aug. 15, 2007 (GB) ..... 0715979.1

(51) Int. Cl.
*F28F 3/10* (2006.01)

(52) U.S. Cl. ..... 29/890.03; 29/890.039; 165/167

(58) Field of Classification Search ..... 29/890.039, 29/890.041, 890.03; 165/157, 167, 166, 165/165

See application file for complete search history.

(56) References Cited

U.S. PATENT DOCUMENTS

| | | | | |
|---|---|---|---|---|
| 2,540,805 | A | 2/1951 | Beebe | |
| 3,308,879 | A | 3/1967 | Maddocks | |
| 4,727,935 | A | 3/1988 | Lapeyre | |
| 4,871,623 | A | 10/1989 | Hoopman et al. | |
| 5,249,358 | A * | 10/1993 | Tousignant et al. | 29/890.03 |
| 5,876,582 | A | 3/1999 | Frazier | |
| 6,378,603 | B1 | 4/2002 | Shimoya et al. | |
| 7,055,588 | B2 * | 6/2006 | Nickolay et al. | 165/167 |
| 2002/0195239 | A1 | 12/2002 | Duerr et al. | |
| 2003/0196451 | A1 * | 10/2003 | Goldman et al. | 62/515 |

FOREIGN PATENT DOCUMENTS

| | | | |
|---|---|---|---|
| DE | 30 17 515 | A1 | 11/1981 |
| DE | 201 14 850 | U1 | 2/2003 |
| EP | 0 397 487 | A2 | 11/1990 |
| EP | 1 256 772 | A2 | 11/2002 |
| EP | 1 837 616 | A2 | 9/2007 |
| GB | 1063098 | | 3/1967 |

OTHER PUBLICATIONS

Mar. 24, 2009 Search Report issued in European Patent Office Application No. EP 08 25 2456.

* cited by examiner

*Primary Examiner* — David Bryant
*Assistant Examiner* — Christopher Besler
(74) *Attorney, Agent, or Firm* — Oliff & Berridge, PLC

(57) ABSTRACT

A heat exchanger is provided in which heat exchanger shells are formed by electro forming about a mandrel. The shells are attached and joined to provide a heat exchanger module. As the shells are not press formed problems with respect to material elongation to achieve deep grooves in the shells are potentially avoided and shells can be created with more desirable thickness to achieve more efficient heat exchange. Furthermore, reduced shell thickness will also reduce weight and therefore improve the acceptability of heat exchangers in particular applications such as those associated with aerospace and automotive sports.

18 Claims, 4 Drawing Sheets

HEAT EXCHANGER

The present invention relates to heat exchangers and more particularly to corrugated type heat exchangers used in order to achieve high thermal transfer efficiencies.

Primary surface heat exchangers using plate geometries with wavy, cross-corrugated, cross-wavy and herringbone geometries are well known. The most common types are assembled by clamping several plates together using tie bolts. By using removable gaskets for sealing, the plates can be separated for cleaning, but this construction is only really suited to low temperature applications.

More recently plate or cross-corrugated heat exchangers have been provided which comprise a stack of pre-formed layers of material secured together through a fusion process at points and lines of contact between the plates. The plates generally have shallow corrugations formed by the pressing process and it will be appreciated that the pressing process presents severe limitations with regard to achieving more efficient deeper corrugations. Deeper corrugations will allow a stiffer structure to be achieved for a given flow path density which is therefore less prone to buckling under compression. Unfortunately, pressing of a flat sheet is limited by elongation effects thus for example a pitch to depth ratio of 2.2 would require an average elongation of about 40% which is not practical for most materials suitable for forming heat exchangers. Furthermore, a mechanical alternative of folding a sheet material to create deeper corrugations may be achieved but then it will be necessary for these corrugations to be "ironed out" at the edges of the plates in order to allow the edges of the plates to be joined together and sealed. All these processes therefore have disadvantages.

It will be understood that heat exchangers are designed for a multitude of environments and uses, and in some circumstances heat exchanger weight and structural strength are not as important as in other uses where heat exchanger weight and strength as well as thermo hydraulic performance are more critical for acceptability.

In accordance with aspects of the present invention there is provided a method of forming a heat exchanger comprising the steps of:

a) forming a mandrel, the mandrel having a surface, b) forming a flow pattern on the surface of the mandrel and providing an association feature on the mandrel, c) providing a coating on the surface of the mandrel to provide a heat exchanger shell with an association feature, d) removing the mandrel from the heat exchanger shell to form a hollow heat exchanger shell, e) arranging a plurality of the hollow heat exchanger shells in a stack such that the association features are aligned, each hollow heat exchanger shell having a flow pattern on an outside surface and a flow pattern on an inside surface, f) consolidating the plurality of hollow heat exchanger shells in the stack to provide a heat exchanger with the association features of the hollow heat exchanger shells aligned such that the flow patterns on the outside surfaces of the hollow heat exchanger shells provide flow channels between the hollow heat exchanger shells.

Normally, the coating is formed by electro-forming onto the mandrel which is an electrode.

Typically, the coating is formed by electro-less deposition on the mandrel.

Typically, the heat exchanger shell is a hollow structure. Alternatively, the heat exchanger shell is an open plate.

Possibly, the heat exchanger shell has an edge flat to facilitate association of the heat exchanger shells in a stack.

Possibly, the heat exchanger shell has apertures to facilitate association of the heat exchanger shells to provide a heat exchanger. Possibly, the apertures are located to coincide when consolidated into the stack to form the heat exchanger.

Generally, the pattern on the mandrel creates diagonal flow channels both inside and outside. The heat exchanger shells and the shells are consolidated so that flow paths in the heat exchanger shells and between adjacent heat exchanger shells cross at a desired angle. A wide range of angles from about 15° to 165° may be used in a counter flow or parallel flow heat exchanger. Possibly, the desired angle is in the range of about 75° to 105° and preferably in the order of about 90° for cross flow designs.

Generally, the mandrel is formed from an electrically conductive material. Possibly, the mandrel is coated with an electrically conductive material. Generally the heat exchanger shell is formed by locating the mandrel in an electro plating bath and an appropriate electrical current passed through the mandrel to cause electro deposition from a plating solution upon the surface of the mandrel to form an electro formed coating as the heat exchanger shell. Alternatively, a so called electro-less process may be used to coat the mandrel.

Electro forming as described herein covers any electro forming processes including those using sacrificial anodes or noble anodes and also the process generally known as electro-less forming where no external electrical circuit or anodes are required.

Typically, the mandrel is sacrificial and is removed to leave the heat exchanger shell. Typically, the mandrel is removed from the heat exchanger shell by melting, evaporation, burning or etching.

Alternatively, if the shell is not a hollow structure is may be prised or otherwise lifted from the mandrel once formed and the mandrel may possibly be reused.

Preferably, the mandrel incorporates a plurality of flow channel patterns in order that the heat exchanger shells create a plurality of flow paths one upon the other within the stack. Generally, the stack is associated with header elements to provide flow path couplings between heat exchanger shells in the stack.

Possibly, the heat exchanger shells are associated to provide a heat exchanger by fusing or bonding or form an electro formed joint or brazing or a suitable alternative process. Alternatively they may be clamped together.

Additionally, the mandrel may be formed with features which have a non-conductive or reduced electrical conductive performance relative to other areas of the mandrel in order to provide variation in electro formed heat exchanger shell thickness.

Typically, the mandrel will include features for providing electrical connection. Generally, the position of electrodes is to provide appropriate shell thickness upon electro forming.

Possibly, a part of the shell is removed to facilitate removal of the mandrel. Possibly, the part of the shell removed is formed upon those parts of the mandrel used to provide electrical connection or handling of the mandrel. Possibly, the parts of the shell removed are necessary to provide openings to the heat exchanger shells in use.

Possibly, the method incorporates providing mandrels in pairs to create heat exchanger shells which are similarly paired for association in order to create a heat exchanger.

Also in accordance with the present invention there is provided a heat exchanger formed by a method as described above.

Further in accordance with aspects of the present invention there is a heat exchanger comprising a plurality of hollow heat exchanger shells associated together in a stack, each hollow heat exchanger shell having a flow pattern on an inside surface and a flow pattern on an outside surface, the flow patterns on the outside surfaces of the hollow heat exchanger shells provide flow channels between the hollow heat exchanger shells.

Potentially, each heat exchanger shell has apertures to reinforce consolidation. Typically, the apertures are located at the contacting junctions therebetween formed shells. Possibly, the apertures receive a bonding material. Possibly, the bonding material is a braze material or an adhesive.

Possibly, the formed shells incorporate fins or other structures to facilitate heat exchange.

Typically, the heat exchanger incorporates header elements to couple flow paths in respective electro formed shells. Possibly, the header elements couple together some of the flow paths in the heat exchanger to one input and output path whilst areas about the other flow paths within the heat exchanger are coupled by header elements to another input flow path and output flow path from the heat exchanger.

Possibly, the heat exchanger is formed from modular segments including a number of electro formed shells associated together whereby the segments are coupled to define the heat exchanger and individual segments are removable for repair or maintenance.

Embodiments of the present invention will now be described by way of example only and with reference to the accompanying drawings in which.

Figure 1:
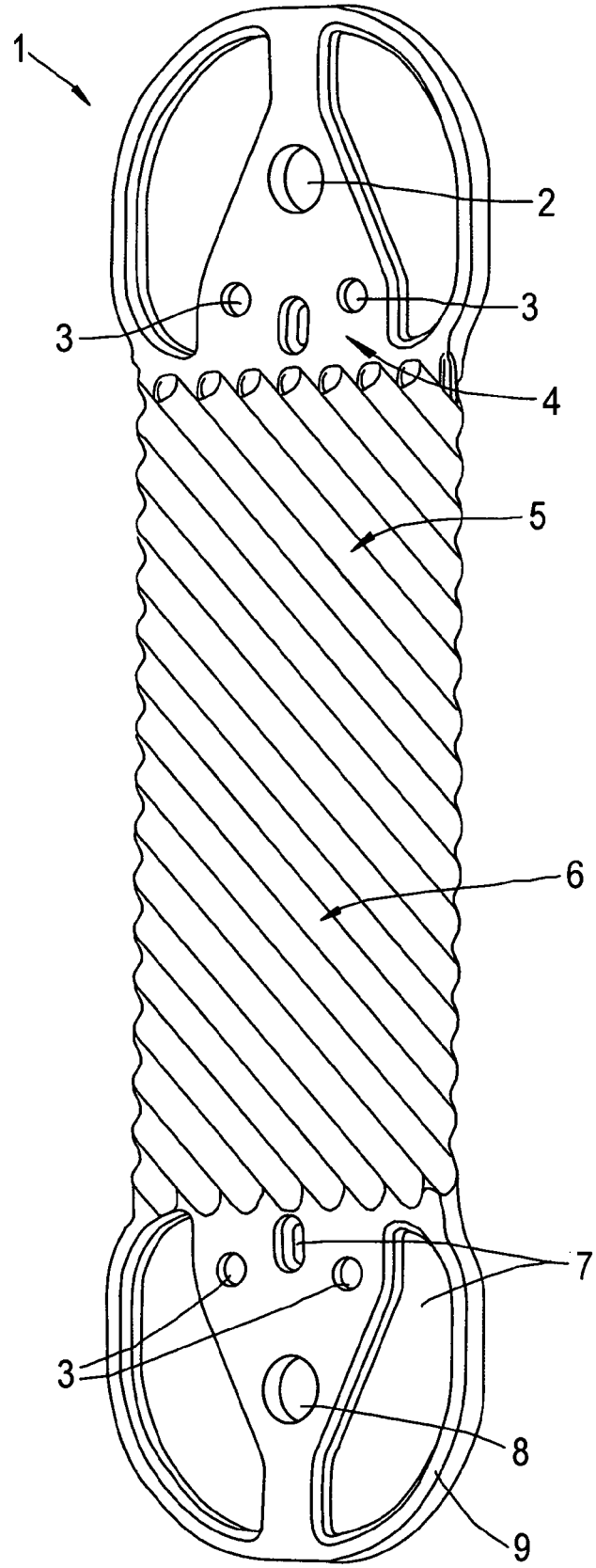
FIG. 1 is an illustration of a heat exchanger shell in accordance with aspects of the present invention.

In accordance with aspects of the present invention multiple electro formed hollow shells are stacked to make a heat exchanger for two or more fluids. The shells are generally flattened in profile, like pancakes. They are either clamped together or permanently bonded. Each hollow shell contains one of the fluids and has openings to manifolds. The manifolds are preferably internal manifolds that interconnect the shells within the envelope of a stack. Possibly, the heat exchangers are primary surface heat exchangers that may have wavy, cross corrugated, cross wavy or herringbone plate geometries, or other new geometries made possible by the present manufacturing process. Optionally the heat exchangers may also incorporate secondary heat transfer surfaces and/or end plates that may or may not be manufactured by electro forming and need not be in the form of hollow heat exchanger shells. Where the shells are bonded together this may be by the use of adhesives, or by brazing or diffusion bonding. Where the shells are not bonded, but merely clamped together, then there is an option to use gaskets to enhance sealing. The shells may have thin walls in order to minimise the weight of the heat exchanger, however the shells at either end of the stack may have thicker walls to facilitate the attachment of manifold connection parts.

Each heat exchanger, or module of a larger heat exchanger, incorporates two or more individual shells of one or more individual designs. Typically, each heat exchanger or module of a heat exchanger incorporates between five and five hundred shells and also one or more end plates.

The shells are made by depositing material onto mandrels. The mandrels are manufactured by any means, but preferably by injection moulding so that they can be mass produced economically. The mandrels may be manufactured of an electrically conductive material, or be given an electrically conductive coating. This conductive coating can be applied by known means, such as dipping, spraying, vacuum coating or electro less plating. Optionally certain areas of each mandrel, or of an electrically conductive coating on the mandrel, may be stopped off with an electrically insulating layer or coating in order to leave functional openings in the electro formed shell.

The mandrels have surface features that may include grooves, ridges, pimples and dimples, disposed so as to generate similar features in the electro formed shells. These features can enhance heat transfer and facilitate the passage of fluids. They may also provide location features for assembly. The mandrels are also provided with one or more features for making electrical connections to them and for suspending the mandrels in the plating bath. They may also be provided with features for handling or tooling purposes, or to help support more fragile parts of the mandrels, or to make connections with runners and risers for injection moulding. The mandrels may also incorporate through holes so that material deposited on the insides of these holes will tie opposite faces of the electro formed shells together. If the holes are relatively large in relation to the thickness of material deposited by electro forming, then they will produce through holes in the electro formed shells. These through holes may be used to generate internal manifolds and/or to provide holes for tie bars or other assembly or mounting features.

The shells may be formed in any material capable of being electro formed (such as copper or nickel), including co-deposited materials that will produce alloys (such as nickel-cobalt nickel-tungsten or nickel-phosphorus). Optionally more than one metal or alloy may be deposited in sequence to give the shells layered structures. This may be done to reduce the porosity of the electro formed shells, to enhance corrosion resistance, to improve thermal conductivity, to control thermal expansion, or to promote adhesion or brazing or diffusion bonding, or for other reasons such as health and safety or aesthetics.

Additional electro formed layers may also be used to provide reinforcement locally where stop off material is not applied to earlier layers. Alternatively, the thickness of each shell may be manipulated locally by disposing non conducting shields to additional electrodes around the mandrel in the plating bath and by regulating the currents to the electrodes.

Some part of each electro formed shell will be cut away after the electro forming process is completed, so that the mandrel material may be removed by an appropriate process, which may for example be by melting, evaporation, burning or etching depending on the material used. Any stop off material will also need to be removed. The parts cut away will typically include those parts of the mandrel used for making the electrical connections and any other tooling or handling features not needed for the final assembly. Preferably the parts cut away are cut away where it is desired to make a functional opening into the shell, such as an opening to a manifold.

The hollow shells and any other components are joined together, either in complete heat exchangers, or into modules that are used to build up larger heat exchanger assemblies. The heat exchangers may be configured for counter flow, cross flow or parallel flow of the fluids, or for more complex multi pass flow arrangements.

Heat exchangers manufactured in these ways can be robust, compact and exceptionally lightweight, making them particularly suitable for aerospace and other weight critical applications. They can have high temperature capability and good thermal and mechanical shock resistance.

Figure 2:
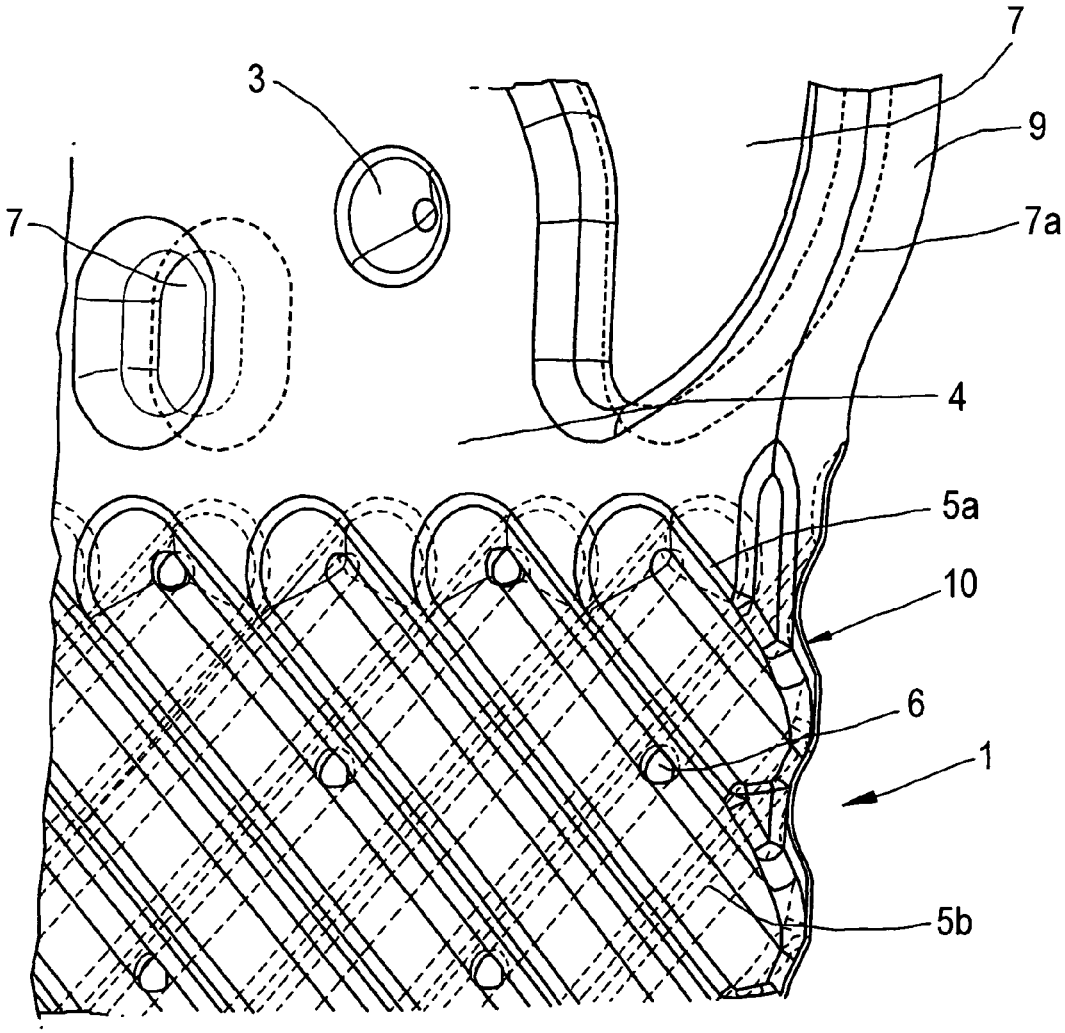
FIG. 2 is a schematic illustration of features of a mandrel for forming an electro formed heat exchanger shell in accordance with aspects of the present invention.
Figure 3:
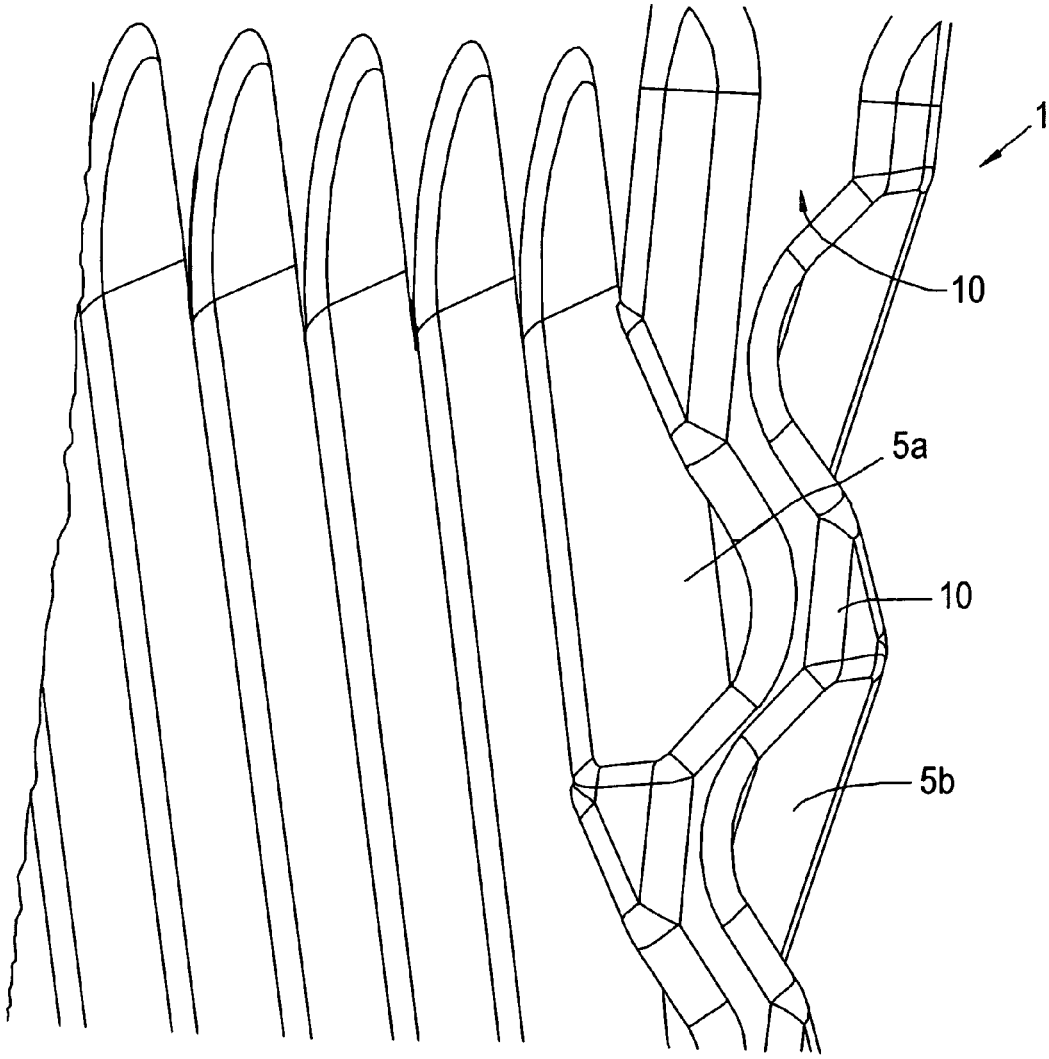
FIG. 3 is an illustration of an edge of the mandrel as depicted in FIG. 2; and, FIG. 4 is a schematic illustration of a heat exchanger.

FIGS. 1 to 3 show a typical mandrel arrangement for a cross flow cross corrugated heat exchanger and preferred design features of mandrels and shells manufactured in accordance with aspects of the present invention. The example design is particularly suitable for a very lightweight air to air heat exchanger for use on an aero engine.

FIG. 1 provides a view of a mandrel 1 for an electro formed shell as part of a cross-corrugated heat exchanger. The shell, as indicated above, is generally formed from an electrically conductive material or from a base material which is coated with an electrically conductive material. As will be appreciated a number of shells 1 will be produced to allow a stack to be formed and then secured together in association in order to create the heat exchanger. Particular features of the mandrel and therefore the shell include a tool hole or attachment point 2 for an electrical connection in an electro plating bath in order to create a shell upon a mandrel 1. Dimples 3 are provided in order to provide a location feature for reference or register with regard to subsequent machining of either the mandrel 1 as formed or an electro plated shell formed upon the mandrel 1 by plating or deposition. The mandrel 1 includes a number of flat surface areas 4 which will facilitate within the electro formed shell the ability to create brazing or diffusion bonding between the shells in a stack in order to create association and to form a heat exchanger.

The mandrel 1 and therefore the electro formed shell formed upon the mandrel 1 will include diagonal grooves with a depth which will typically be almost half the thickness of the mandrel 1 in order to create respective cross flow passages in a heat exchanger for lower pressure resistance in a finally formed heat exchanger. It will be understood that similar grooves will be formed in the rear surface of the mandrel 1. The grooves 5 as indicated above in FIG. 1 are diagonal but it will be appreciated that other orientations of the grooves may be provided particularly with regard to determining the desired cross angles between respective flow path passages in layers of a finally formed heat exchanger. Furthermore, a small hole or aperture 6 may be provided within the mandrel 1 where some or all of the grooves on opposite faces intersect.

The mandrel 1 may also include larger through holes 7 which can provide various association features in terms of fluid distribution within a final heat exchanger or provide registration for machining purposes.

The mandrel 1 may also include brace areas 8 which will act to support and keep separate other parts of the mandrel during electro forming of a heat exchanger shell. These brace areas will typically be cut away once the shell has been formed in order to create the heat exchanger. Typically, part of the mandrel 1 will be utilised in order to create through electro forming the walls 9 of an integral manifold in a final heat exchanger comprising a stack of electro formed heat exchanger shells secured together. The manifold sections or walls 9 are brazed or otherwise secured together in order to create a manifold from one or more of the through holes 7.

FIG. 2 provides a more detailed illustration of part of the mandrel 1 depicted in FIG. 1. As can be seen in the depiction of FIG. 2 and presented as a transparency with solid lines providing an outline of respective features in the mandrel 1 on a visible front surface whilst broken lines illustrate features in the bottom surface of the mandrel 1. As indicated above, the mandrel 1 will create a heat exchanger shell by electro forming which will reflect the mandrel 1 shape. In such circumstances a dimple 3 or other feature is used to allow registration and association of the electro formed heat exchanger shell for subsequent machining processes along with location relative to other shells in a stack and the hole 7 may create through a wall portion 9 a manifold for the heat exchanger. Of particular interest in FIG. 2 is the creation of grooves or corrugations 5 on either side of the mandrel 1. It will be noted that the grooves 5 are diagonal but respectively grooves 5*a*, 5*b* on each side of the mandrel 1 are substantially perpendicular to each other but the desired angle may typically range from 75° to 105°. At locations of cross over between the grooves 5*a*, 5*b* holes or apertures 6 are provided.

It will be noted that all external edges such as edge 10 except those for tooling holes will be smoothly rounded off. Such smoothing is desirable in order to achieve uniform material deposition in order to create heat exchanger shells of the desired thickness and integrity for forming a heat exchanger in accordance with aspects of the present invention.

FIG. 3 provides an edge 10 perspective view of the mandrel 1 depicted in FIGS. 1 and 2. The edge 10 develops into grooves 5*a*, 5*b* which as described previously are arranged diagonally and to cross at various positions at a desired angle. In such circumstances the edge 10 is generally wavy in the region of the grooves 5*a*, 5*b* but as indicated above is generally smooth in order to provide uniform material deposition upon the mandrel 1.

As described above, the processes of electro forming and electro-less deposition are well known and it will be appreciated in such circumstances the mandrel 1 will be located within an appropriate plating bath incorporating an electrolyte. Thus, by providing if necessary an electrical current through the mandrel 1 it will be understood that there will be deposition of a material such as copper upon the mandrel 1 in order to create the electro formed heat exchanger shells in accordance with aspects of the present invention. Such an approach enables cross flow designs and thinner plates with deeper corrugations to eliminate many of the bonded joints—increasing the effective surface area of the heat exchanger and it opens up the possibility of more sophisticated heat transfer surface geometries. Because the flattened shells can be manufactured with rounded edges, and with more complex profiles than a simple pressed sheet, the entry and exit losses for an open sided cross flow matrix can be significantly reduced.

Experiments have confirmed that the thermo hydraulic performance (volume goodness and area goodness) of a cross corrugated primary surface heat exchanger matrix, having intersection angles of around 90 degrees between the corrugations and suitable for a cross flow design, is greatly improved by having deeper corrugations of typically 2.2 or less pitch to depth ratio. Deeper corrugations will also result in a stiffer structure for a given density and one that is less prone to buckling on compression. Conversely, they can provide a lighter structure for a given strength, because thinner sections can be used. However, the previous plate cross corrugated heat exchangers and some other proposed matrix designs use shallower corrugations. One reason for this is that it is difficult to produce deep corrugations in a flat sheet simply by pressing. A pitch to depth ratio of 2.2 requires an average elongation of about 40%, which is not practical for most materials. Folding can produce deeper corrugations, but then these corrugations will need to be ironed out at the edges of the plates so that the edges of the plates can be joined together and sealed. This is a difficult and labour intensive process that requires special machinery, such as that described in U.S. Pat. No. 4,434,637.

The difficulty in manufacturing plates with deep corrugations and flat edges is overcome by electro forming, and the number of parts to be assembled is halved by producing the plates in pairs as the opposite sides of hollow shell structures. In a brazed assembly this also reduces the amount of braze material needed, and the reduction in heat transfer surface area due to brazing is further reduced if opposing faces of the shells are tied together by perforating the mandrel where the corrugations intersect with apertures, so that braze metal or other bonding material is not needed there. In this case the higher pressure fluid is most advantageously retained within the shells, while the lower pressure fluid fills the passages formed between the shells. There is then no need to bond the shells together except around the manifolds, and simpler cross flow heat exchangers can be produced.

The example provided above is generally of an open sided cross flow heat exchanger with electro formed heat exchangers shells secured together to create one set of integral manifolds. However, the same principles can be used to manufacture a counter flow or parallel flow heat exchanger, optionally with two or more pairs of integral manifolds. For a design using two fluids, a first fluid may reside in the interstices between the shells containing a second fluid, or alternatively each fluid may be contained within its own set of shells. The latter arrangement would be particularly advantageous in a heat exchanger where it is necessary to ensure that one fluid can never contaminate the other and the heat exchanger needs to be provided with a "tell tale" drains system to show up any leaks.

Alternatively, the heat exchanger may be configured for use with more than two fluid streams.

The heat exchanger may also be a hybrid design that incorporates secondary heat transfer surfaces on one or more flow sides, typically this will be the side with the lower density fluid.

The electro formed shells may be clamped together rather than being permanently bonded. Their inherent flexibility can be used to provide a good seal between adjacent shells, with or without separate gaskets.

As will be appreciated heat exchangers in accordance with aspects of the present invention are quite compact and lightweight relative to other heat exchanger designs such that they have particular suitability in weight sensitive applications or other situations such as with automotive or auto sport applications. Furthermore, it will be understood that the heat exchangers formed by heat exchanger shells in accordance with aspects of the present invention are not limited to air to air heat exchangers, even though they are particularly suitable for such applications.

As indicated above by use of electro forming for the heat exchanger shells a heat exchanger can be provided. In particular, electro forming of the shells which create the heat exchanger can allow variation in shell thickness without limitations with regard to pressing processes. In such circumstances the thickness of the respective shells can be reduced in comparison with pressed shells and heat exchanger weight adjusted and typically lowered accordingly. Furthermore, by consideration of the overall heat exchanger structure it may be possible, through appropriate techniques with regard to conduction, insulation and adjustment of electrical current flow through the mandrel, and auxiliary electrode placed around the mandrel to define a relatively thick skeleton structure for the heat exchanger shell with thinner wall sections between that skeleton or web reinforcement. This may again reduce the weight of the heat exchanger shell and therefore the stack formed as an overall heat exchanger. In any event, features such as apertures can be formed in this way Methods of forming heat exchangers in accordance with the present invention will include initially defining the mandrel upon which through electro forming the heat exchanger shells will be formed. Typically, as indicated above, these mandrels will be injection moulded with smooth surfaces where required. The mandrels may be reusable or removable as required. In either event it will be understood that the electro formed heat exchanger shell must be detached from the mandrel at some stage. In such circumstances the mandrel will typically include areas which can be removed in order to allow detachment or otherwise separation of the mandrel from the formed shell. Initial design of the mandrel is therefore important in order to create the desired heat exchanger shell geometry for combination in a stack as a heat exchanger.

The electro forming process to create the heat exchanger shell as well as features necessary in order to create that shell and removal of the shell from the mandrel are known. Typically, as illustrated above, the mandrel must be submersed in an electro plating bath and therefore a tool or method of suspending the mandrel in that bath must be provided along with a means for providing an electrical coupling to the mandrel. Features necessary for such tool manipulation and electrical coupling will clearly not be required in the eventual heat exchanger 4 and therefore will be removed or provided with an auxiliary use within the heat exchanger formed as part of a distribution manifold or otherwise.

As described above, the mandrel may create non re-entrant heat exchanger shells such that flow paths are created by adjacent shells in the stack forming the heat exchanger. Alternatively, a mandrel may create a heat exchanger shell which is essentially a hollow structure with the mandrel in the centre and electro forming over the whole surface of the mandrel. In such circumstances the mandrel must be removed and generally this will be achieved through melting, burning, erosion or etching to leave the hollow structure which can then be assembled in a stack to form the heat exchanger.

As indicated above the mandrel may incorporate features which have a non or reduced electrically conductive nature in order to vary the shell thickness as required. It will also be understood that positioning of the electrodes may adjust the effectiveness of electro forming and therefore shell thickness as required. Typically an appropriate number of electrodes (anodes) electrically connected to the mandrel will be disposed so as to achieve the desired shell thickness. Mandrel removal may be through melting, evaporation, burning or etching but care must be taken, as the shell will generally be of a thin nature, to avoid distortions within that shell which may result in malformation of the stack and therefore eventual heat exchanger.

Possibly, mandrels will be arranged in order that heat exchanger shells are created in pairs which can then be associated together in order to define flow paths and channels through an eventual heat exchanger stack. In such circumstances as described above respective heat exchanger shells may incorporate dimples or other features to achieve registration and reference. These dimples will also provide a reference for machining of the respective shells as required subsequent to formation on the mandrel.

Figure 4:
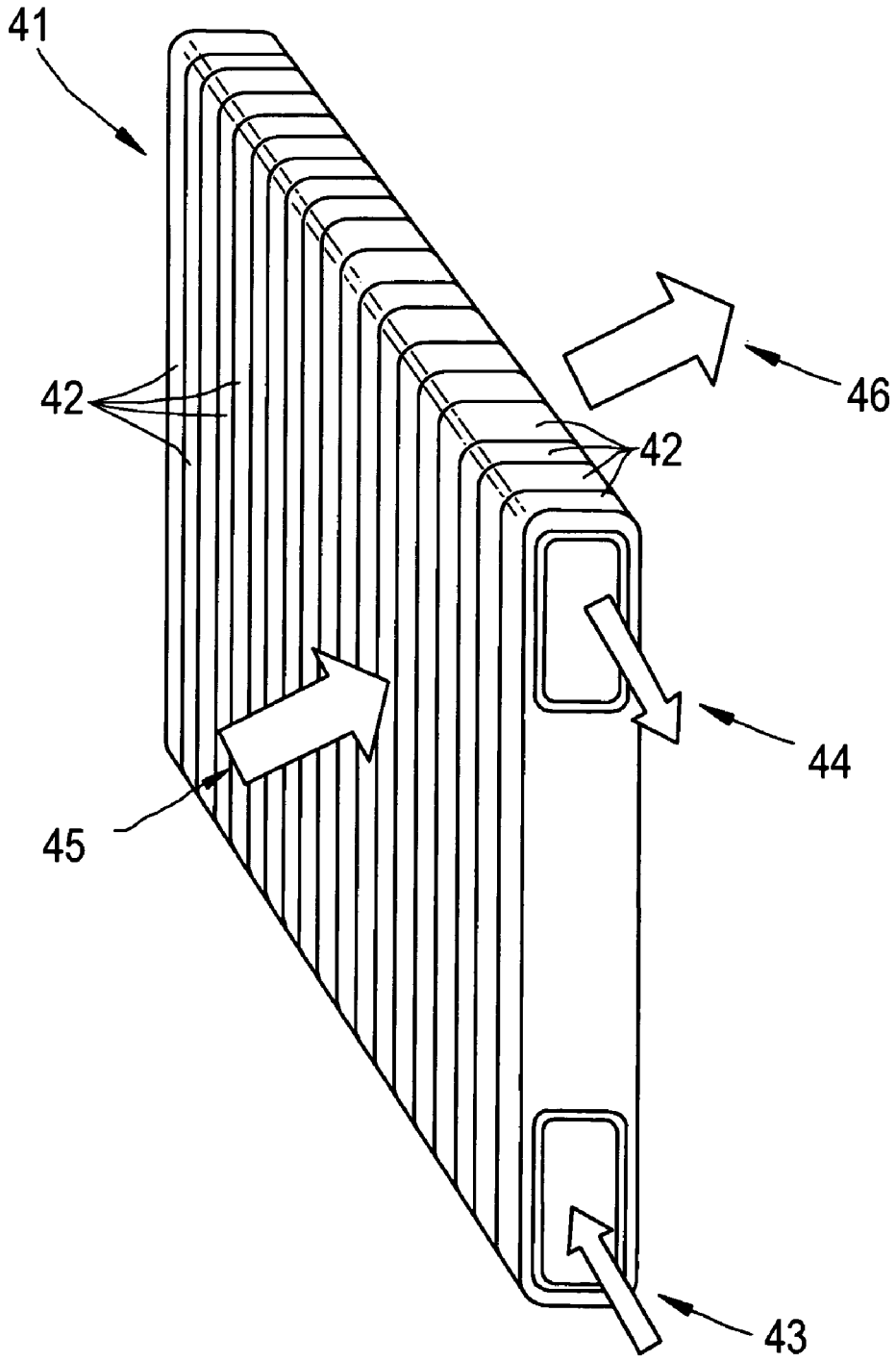

For context FIG. 4 provides a schematic illustration of a heat exchanger 41 comprising a number of heat exchanger shells 42 formed into a stack. The shells 42 are electro formed upon mandrels as described above and associated appropriately by contacting junctions between parts of the shells 42 or pressed together with bolts (not shown). The heat exchanger 41 has a first inlet 43 and outlet 44 pair for a first fluid X and a second inlet 45 and outlet 46 pair for a second fluid Y so that there is cross flow and heat exchange between the fluids X, Y. Modifications and alterations to the present invention will be understood by those skilled in the art and therefore it will be appreciated that via an appropriate design and choice of the mandrel a wider range of heat exchanger shells can be provided than were possible with previous systems which effectively pressed a flat sheet of material in order to define the channels in respective plates which were then secured together in a stack to provide a heat exchanger.

We claim:

1. A method of forming a heat exchanger comprising the steps of:

a) forming a mandrel, the mandrel having opposite surfaces, b) forming apertures between the opposite surfaces of the mandrel and providing an association feature on the mandrel, forming grooves on the opposite surfaces of the mandrel, arranging the grooves on the opposite surfaces of the mandrel such that they intersect and forming the apertures within the mandrel where some or all of the grooves on the opposite surfaces of the mandrel intersect, c) providing a coating on the surface of the mandrel to provide a heat exchanger shell with an association feature, d) removing the mandrel from the heat exchanger shell to form a hollow heat exchanger shell, e) arranging a plurality of the hollow heat exchanger shells in a stack such that the association features are aligned, each hollow heat exchanger shell, formed in step d) has grooves on the opposite outside surfaces and a flow pattern on an inside surface, the grooves on the opposite outside surfaces of each hollow heat exchanger shell intersect and apertures extend through each hollow heat exchanger shell where some or all of the grooves on the opposite outside surfaces of the hollow heat exchanger shell intersect, f) consolidating the plurality of hollow heat exchanger shells in the stack to provide a heat exchanger with the association features of the hollow heat exchanger shells aligned, the hollow heat exchanger shells are aligned such that the grooves on the outside surfaces of the hollow heat exchanger shells provide flow channels between the hollow heat exchanger shells.

2. A method as claimed in claim 1 wherein step c) comprises providing the coating by electro forming onto the mandrel, the mandrel is an electrode for the electro forming.

3. A method as claimed in claim 1 wherein step c) comprises providing the coating by electro-less deposition on the mandrel.

4. A method as claimed in claim 1 wherein the association feature of the heat exchanger shell comprises an edge flat to facilitate association of the hollow heat exchanger shells in the stack.

5. A method as claimed in claim 1 wherein the association feature of the heat exchanger shell comprises a plurality of apertures to facilitate association of the hollow heat exchanger shells in the stack.

6. A method as claimed in claim 1 wherein step b) comprises forming diagonal grooves on the surface of the mandrel.

7. A method as claimed in claim 6 wherein step e) comprises arranging the hollow heat exchanger shells so that grooves in adjacent hollow heat exchanger shells cross at a desired angle.

8. A method as claimed in claim 7 wherein the desired angle is in the range of 75° to 105°.

9. A method as claimed in claim 7 wherein the desired angle is about 90°.

10. A method as claimed in claim 2 wherein step a) comprises forming the mandrel from an electrically conductive material.

11. A method as claimed in claim 2 wherein step a) comprises coating the mandrel with an electrically conductive material.

12. A method as claimed in claim 2 wherein step c) comprises locating the mandrel in an electro plating bath, passing an electrical current through the mandrel to cause electro deposition from a plating solution upon the surface of the mandrel to form an electro formed coating as the heat exchanger shell.

13. A method as claimed in claim 1 wherein step e) comprises associating the stack with head elements to provide flow path couplings between the heat exchanger shells in the stack.

14. A method as claimed in claim 1 wherein step f) comprises associating the hollow heat exchanger shells to provide a heat exchanger by a method selected from the group comprising bonding and brazing.

15. A method as claimed in claim 1 wherein step a) comprises forming the mandrel with features which have reduced electrical conductive performance relative to other areas on the mandrel in order to provide variation in electro formed heat exchanger shell thickness.

16. A method as claimed in claim 1 wherein step d) comprises removing the mandrel from the heat exchanger shell, a method selected from the group comprising melting, evaporation, burning and etching.

17. A method as claimed in claim 1 wherein step b) comprises forming the diagonal grooves on the opposite surfaces of the mandrel such that the diagonal grooves cross at an angle in the range of 75° to 105°.

18. A method as claimed in claim 1 wherein step b) results in a pitch to depth ratio of the grooves of 2.2 or less.

* * * * *